US007984952B2

(12) United States Patent
Begin et al.

(10) Patent No.: US 7,984,952 B2
(45) Date of Patent: Jul. 26, 2011

(54) MODULAR VEHICLE SEAT HAVING WATER-PERMEABLE SEATING SURFACES

(75) Inventors: Jason Ernest Begin, Rockford, MI (US); Stephen Getson, Grand Rapid, MI (US); Daniel Sommerfeld, Kalamazoo, MI (US)

(73) Assignee: Brunswick Corporation, Lake Forest, IL (US)

( * ) Notice: Subject to any disclaimer, the term of this patent is extended or adjusted under 35 U.S.C. 154(b) by 968 days.

(21) Appl. No.: 11/225,521

(22) Filed: Sep. 13, 2005
(Under 37 CFR 1.47)

(65) Prior Publication Data

US 2006/0202540 A1 Sep. 14, 2006

Related U.S. Application Data

(63) Continuation-in-part of application No. 10/965,558, filed on Oct. 14, 2004, now Pat. No. 7,347,499.

(51) Int. Cl.
*A47C 7/02* (2006.01)

(52) U.S. Cl. ..... 297/452.56; 297/DIG. 2; 297/411.4; 297/452.65; 297/411.44

(58) Field of Classification Search ..... 297/DIG. 2, 297/451.11, 452.13, 452.48, 452.46, 452.47, 297/440.15, 452.65, 452.41, 411.2, 411.4, 297/452.52, 452.56, 411.44
See application file for complete search history.

(56) References Cited

U.S. PATENT DOCUMENTS 1,623,259 A * 4/1927 McGregor et al. ..... 297/411.24
2,575,467 A * 11/1951 Reichel et al. ..... 452/32
2,774,975 A * 12/1956 Frank ..... 4/254
2,797,738 A * 7/1957 Patterson ..... 297/344.18
3,663,057 A * 5/1972 Lohr et al. ..... 297/452.14
3,895,141 A 7/1975 Steele et al.
4,073,539 A * 2/1978 Caruso ..... 297/452.14
4,914,772 A * 4/1990 Difloe ..... 5/652.1
5,338,094 A * 8/1994 Perry ..... 297/411.4
5,405,179 A * 4/1995 Jih ..... 297/452.49
5,522,645 A * 6/1996 Dahlbacka ..... 297/452.55
5,725,276 A * 3/1998 Ginat ..... 297/289
5,924,769 A * 7/1999 Kao ..... 297/411.44
6,050,644 A * 4/2000 Neal ..... 297/411.24
6,059,368 A 5/2000 Stumpf et al.
6,065,197 A 5/2000 Iseki et al.
6,089,669 A * 7/2000 Wilcox et al. ..... 297/452.65
6,164,725 A * 12/2000 Santa Cruz et al. ..... 297/411.29
6,292,990 B1 9/2001 Iseki et al.
6,361,117 B1 * 3/2002 Tate ..... 297/452.56
6,378,944 B1 4/2002 Weisser (Continued)

*Primary Examiner* — David Dunn
*Assistant Examiner* — Erika Garrett
(74) *Attorney, Agent, or Firm* — Hanley, Flight & Zimmerman, LLC

(57) ABSTRACT

Modular vehicle seats having water-permeable seating surfaces are disclosed. A disclosed vehicle seat includes a seat portion configured to hold a seated person. The seat portion includes a substantially unitary molded frame defining a first opening and a cavity associated with the first opening. The seat portion further includes a first substantially non-absorbent, water-permeable membrane configured to cover at least a portion of the first opening to provide support to the seated person. The substantially unitary molded frame comprises at least a second opening configured to enable water passing through the first substantially non-absorbent, water-permeable membrane and into the cavity to be discharged from the cavity. The disclosed seat further includes a back portion coupled to the seat portion. The back portion includes a peripheral frame member defining a third opening at least a portion of which is covered with a second substantially non-absorbent, water-permeable membrane.

15 Claims, 7 Drawing Sheets

U.S. PATENT DOCUMENTS

| | | | | |
|---|---|---|---|---|
| 6,540,950 | B1 | 4/2003 | Coffield | |
| 6,565,155 | B1 * | 5/2003 | Huang | 297/353 |
| 6,644,751 | B2 * | 11/2003 | Ratza et al. | 297/452.52 |
| 6,702,390 | B2 | 3/2004 | Stumpf et al. | |
| 6,726,286 | B2 | 4/2004 | Sayers et al. | |
| 6,733,084 | B2 * | 5/2004 | Butler | 297/452.56 |
| 6,802,563 | B1 * | 10/2004 | Mysliwiec et al. | 297/284.9 |
| 6,842,959 | B2 * | 1/2005 | Coffield et al. | 29/449 |
| 6,983,997 | B2 * | 1/2006 | Wilkerson et al. | 297/452.56 |
| 7,207,629 | B2 * | 4/2007 | Goetz et al. | 297/318 |
| 2003/0034682 | A1 | 2/2003 | Stumpf et al. | |
| 2003/0137179 | A1 | 7/2003 | Coffield | |
| 2003/0168901 | A1 | 9/2003 | Wilkerson et al. | |
| 2005/0248205 | A1 * | 11/2005 | Neil et al. | 297/452.18 |

* cited by examiner 126
100
130
116
118
122
128
114
120
124
106
108
112
140
104
110
102
132
136
142
144
138
134

MODULAR VEHICLE SEAT HAVING WATER-PERMEABLE SEATING SURFACES

RELATED APPLICATION

This application is a continuation-in-part of U.S. patent application Ser. No. 10/965,558, entitled "Marine Seat Interchangeable Component Assembly and Method," filed on Oct. 14, 2004, now U.S. Pat. No. 7,347,499 the entire disclosure of which is incorporated by reference herein in its entirety.

FIELD OF THE DISCLOSURE

The present disclosure relates generally to vehicle seats, more specifically, to modular vehicle seats having water-permeable seating surfaces.

BACKGROUND

Many known vehicle seats are constructed of foam padding covered with cloth, vinyl, leather, etc. While such vehicle seats can offer a seat occupant a comfortable seating surface, these seats are not typically well suited for use in applications in which larger amounts of moisture and/or liquid water (e.g., marine applications, off-road vehicle applications, vehicles having seats exposed to the outdoor environment, etc.) may be present. For example, cloth, leather, foam padding, and the like may absorb liquid water and/or perspiration resulting in a wet, uncomfortable seating surface for the seat occupant. The retention of liquid by these seats may further aggravate occupant discomfort in cases where mold, bacteria, and other unhealthy and/or offensive contaminants collect on the seat materials.

To prevent the absorption of water by seating materials in, for example, marine applications, the seat may be upholstered with a heavy, non-water permeable material such as a heavy vinyl. While such seats can prevent the absorption of water by the seating surfaces, water may nevertheless collect or pool on the seating surfaces, particularly the seat bottom portion. As a result, the seat occupant may be forced to sit in pools of liquid water, which may be very uncomfortable, particularly in cases where the outdoor temperatures are relatively low and/or where the seat occupant must remain seated for relatively long periods of time. Additionally, while the vinyl seating surfaces may be substantially non-permeable to water, the seams between the vinyl panels composing the seating surfaces may not be non-water permeable. As a result, water may pass through the seams and into the foam and/or other padding within the seat. Still further, even if liquid water has not collected on the heavy vinyl seating surfaces, these surfaces do not breathe well and, thus, may cause the portions of the seat occupant's body that are in contact with the seating surfaces to become uncomfortable.

Another difficulty commonly encountered with vehicle seats is a lack of application flexibility. More specifically, a vehicle seat design for use in a particular type and/or model of vehicle may not be suitable for use in another type and/or model of vehicle. As a result, a vehicle seat manufacturer may be forced to design, produce, and/or inventory a relatively large number of seats and related components.

DETAILED DESCRIPTION

Figure 1:
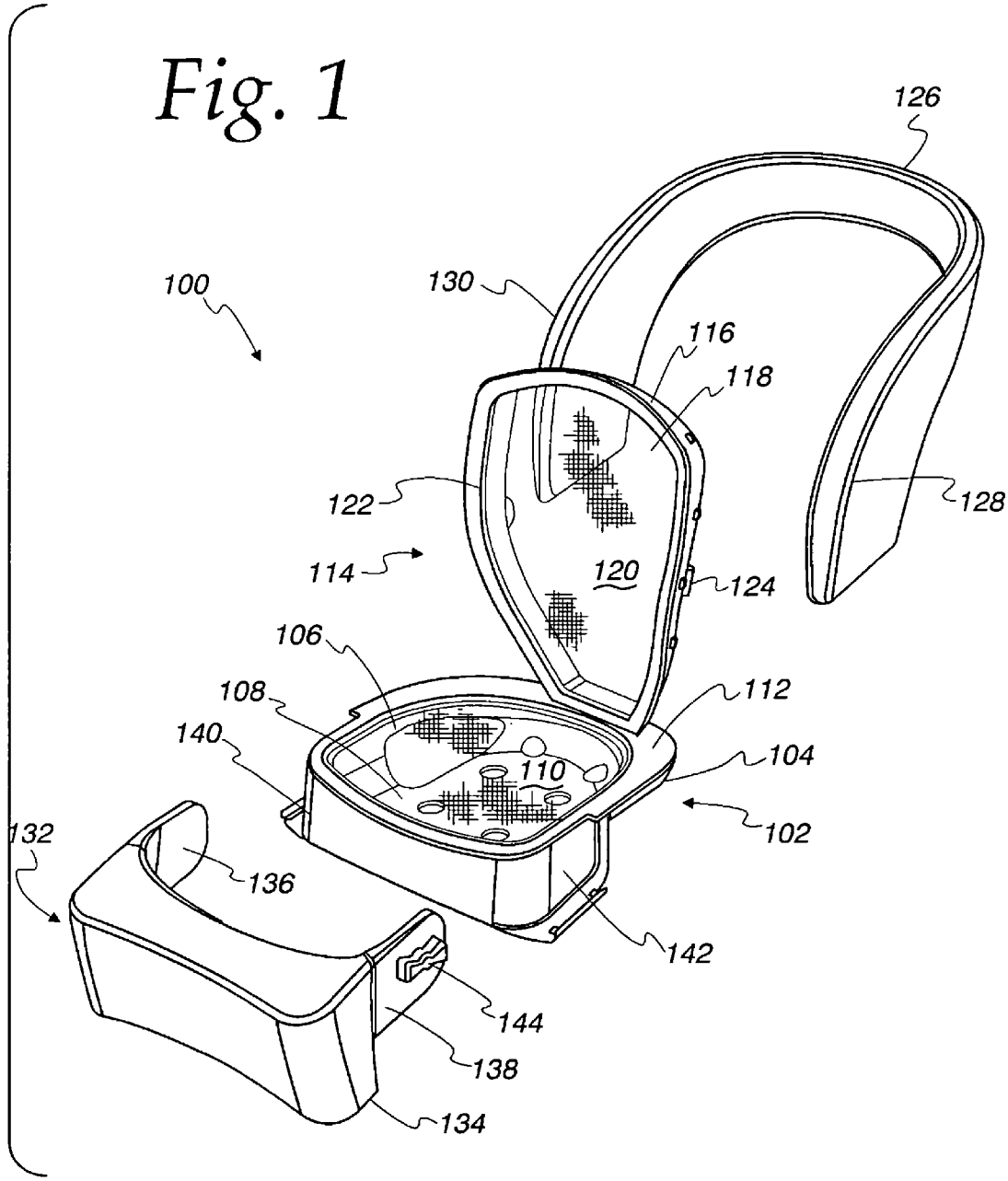
FIG. 1 is an exploded perspective view of an example vehicle seat having water-permeable seating surfaces and a rotatable bolster.

The example vehicle seat described herein is configured to manage liquid water in a manner that greatly improves comfort of a seat occupant. More specifically, the example vehicle seat described herein utilizes substantially non-absorbent, water-permeable seating surfaces (e.g., seat bottom, seat back, bolster, etc.) that facilitate the passage of liquid water away from the seating surfaces and, thus, the portions of a seat occupant's body in contact with the seating surfaces. In some examples, the seating surfaces of the example vehicle seats may be made of a substantially non-absorbent, water-permeable membrane such as, for example, a synthetic (e.g., plastic) mesh material. However, other suitable substantially non-absorbent, water-permeable materials could be used instead of or in addition to a plastic mesh material.

The example vehicle seat described herein is configured to provide a high degree of modularity (e.g., interchangeability of components) to provide a relatively high degree of application flexibility. In some examples, a seat bottom and back may be configured to be removably coupled to a substantially unitary armrest assembly via complementary interlocking structures. The substantially unitary armrest assembly may, for example, be removably coupled to a seat back via complementary male and female structures or members to thereby support the seat back and to provide a pair of armrests. In this manner, a plurality of different armrest assemblies can be interchangeably coupled to the vehicle seat to change the aesthetics (e.g., color, shape, etc.) and/or functionality (e.g., size and/or position of the armrest) of the vehicle seat to suit different applications and/or customer preferences. The various structural components of the example vehicle seat described herein may be made of one or more types of molded plastic materials to minimize the cost and/or weight of the vehicle seats. In particular, blow-molded plastic components having a hollow core may be particularly useful for producing such lightweight vehicle seats inexpensively.

The example vehicle seat described herein also includes a rotatable bolster. In particular, the rotatable bolster is configured to rotate relative to a seat base or bottom of the vehicle seat. Rotating the bolster upward (e.g., into a substantially vertical position) relative to the seating surface of the seat base provides additional space in front of the vehicle seat to facilitate a person standing in front of the seat which may, for example, be desirable in the case of driving a boat. For example, many boat operators desire to stand in front of their seat (i.e., the driver's seat) when docking, launching, and/or piloting their boat in other similar situations requiring a better view of the hull of the boat in relation to objects with which the boat may collide. Alternatively or additionally, with the bolster rotated to the upward or substantially vertical position, a vehicle operator (e.g., boat operator) may sit on the bolster in an elevated position that also facilitates certain maneuvers (e.g., docking in the case of a boat). As with the other seating surfaces (e.g., the seat bottom, back, etc.), the rotatable bolster may be upholstered with a substantially non-absorbent, water-permeable material or fabric such as, for example, a mesh material or the like. Of course, the rotatable bolster may instead be upholstered with a substantially non-water permeable material or fabric such as vinyl.

Turning now to FIG. 1, an exploded assembly view of an example vehicle seat 100 is shown. The example vehicle seat 100 includes a seat portion 102 configured to hold a seated person. The seat portion 102 includes a substantially unitary molded frame 104 defining an opening 106 and a cavity 108 associated with the opening 106. The seat portion 102 further includes a substantially non-absorbent, water-permeable membrane 110 that covers the opening 106 to function as a seating surface to provide support to a seated person. As described in greater detail below in connection with FIG. 6, the substantially unitary molded frame 104 may include one or openings (e.g., located at the bottom of the cavity 108) configured to enable and facilitate liquid water passing through the membrane 110 and into the cavity 108 to be discharged from the cavity 108. In this manner, liquid water is not trapped between the seating surface (e.g., the membrane 110) and the seat occupant's body, thereby greatly improving the comfort of the seat occupant in applications (e.g., marine applications) in which large amounts of moisture and/or liquid water are typically present.

The unitary molded frame 104 may be made of an injection molded plastic material. However, other suitable materials including fiberglass, lightweight metals, etc. could be used instead of or in addition to plastic materials. Also, although the frame 104 is shown and described as being unitary in construction, the frame 104 could instead be composed of a plurality of components fastened together using any suitable fasteners, adhesives, ultrasonic welding, etc. Additionally, as described in greater detail below, the frame 104, or portions thereof, may be upholstered or otherwise covered with fabric or other suitable material(s) to provide a desired aesthetic property, texture, functionality, etc.

The substantially non-absorbent, water-permeable membrane 110 is fixed over the opening 106 via a carrier 112. In some examples, the membrane 110 may be made of a plastic material. However, natural and/or synthetic materials or fabric(s) could be used instead of or in addition to plastic materials. The carrier 112 may be made of a plastic material and configured to be pressed into a channel or the like (not shown) of the frame 104. An example manner of attaching a membrane to a seat via a carrier is described in U.S. Pat. No. 6,540,950, the entire disclosure of which is incorporated herein by reference.

The example vehicle seat 100 also includes a back portion 114 that is coupled to the seat portion 102. The back portion 114 includes a peripheral frame member 116 defining an opening 118. Similar to the seat portion 102, the back portion 114 includes a substantially non-absorbent, water-permeable membrane 120 (e.g., a plastic mesh material) that is held via a carrier 122 to cover the opening 118. The peripheral frame member 116 includes one or more coupling or locking structures 124 (only one of which is shown) that are complementary to and which interlock with structures (not shown) of a substantially unitary u-shaped structure, armrest member or structure 126. Thus, the armrest structure 126 is configured to be removably coupled to the seat portion 102 and the back portion 114 to form armrests 128 and 130. Additionally, the armrest structure 126 may provide support to the back portion 114 to maintain the back portion 114 in a relatively vertical relation to the seat portion 102. While one example armrest structure is shown in FIG. 1, a variety of different armrest structures may be used instead. Such different armrest structures may provide different armrest shapes, geometries, aesthetic properties, etc. to suit the needs of a particular application. The armrest structure 126 may be made of a molded plastic material (e.g., having a hollow core or central area) and upholstered or otherwise covered with a fabric, vinyl, or any other suitable material.

Figure 5:
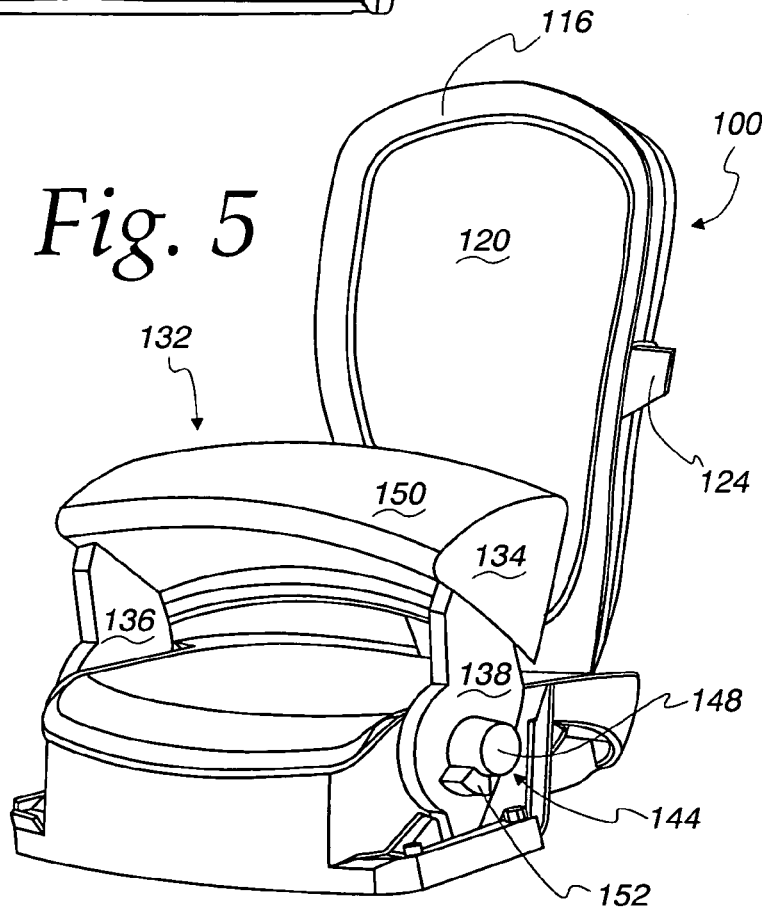
FIG. 5 is a perspective view of the example seat of FIG. 1 with the bolster assembly rotated to a substantially vertical position.

The example vehicle seat 100 also includes a bolster assembly 132 having a body portion 134, and projecting tabs or plates 136 and 138. The tabs or plates 136 and 138 are configured to engage with complementary recessed areas 140 and 142, respectively, of the frame 104. The tabs or plates 136 and 138 include one or more structures 144 (one of which is shown) that are configured to engage (e.g., interlock) with complementary structures (not shown) on the armrest structure 126. The tabs 136 and 138 and locking structures 144 are configured to enable the bolster assembly 132 to be rotated relative to the seat portion 102. Further, the tabs 136 and 138 and/or the structures 144 are configured so that the bolster assembly 132 can be maintained in a substantially horizontal condition relative to the seat portion 102 and one or more rotated positions in which the bolster assembly 132 is held at an angle relative to the seat portion 102. The angled positions of the bolster assembly 132 provide additional clearance in front of the seat portion 102, thereby providing a person (e.g., a vehicle operator) standing in front of the seat 100 additional room to maneuver to facilitate operation of a vehicle (e.g., docking a boat). Additionally or alternatively, as shown in FIG. 5, the bolster assembly 132 may be rotated to a substantially vertical position that enables a person to rest against or to be seated on the bolster assembly, thereby providing an elevated position for the person to facilitate certain vehicle maneuvers (e.g., docking a boat). The body portion 134 of the bolster assembly 132 may be upholstered or otherwise covered with a substantially non-absorbent, water-permeable membrane, a substantially non-water permeable material such as vinyl, and/or any other desired fabric or material.

Figure 2:
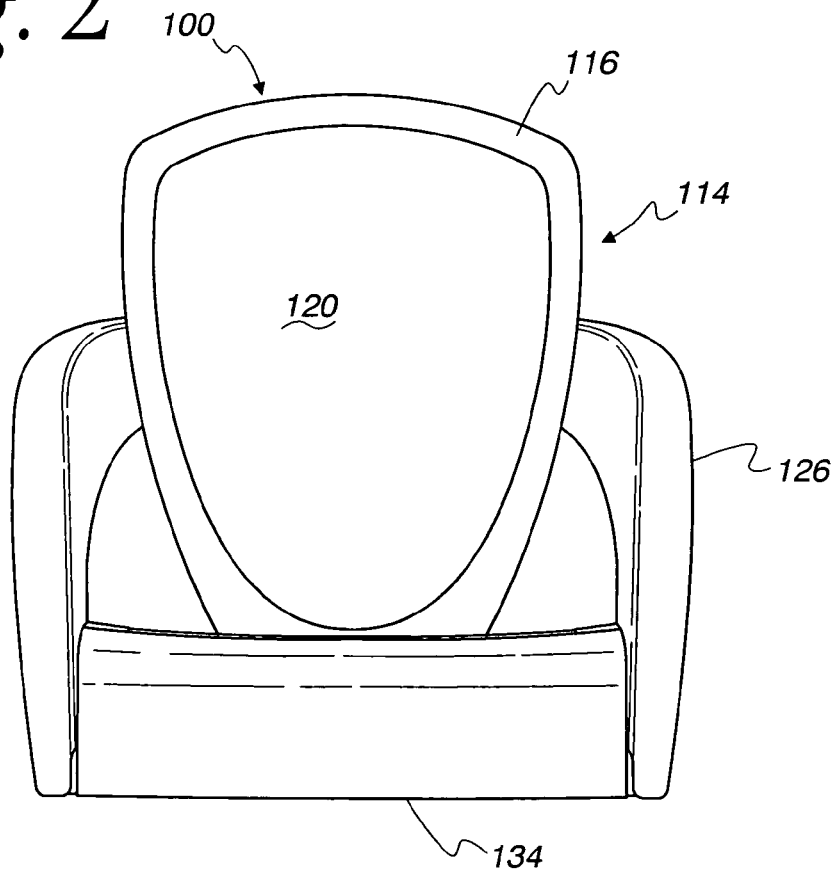
FIG. 2 is a front view of the example seat of FIG. 1.
Figure 3:
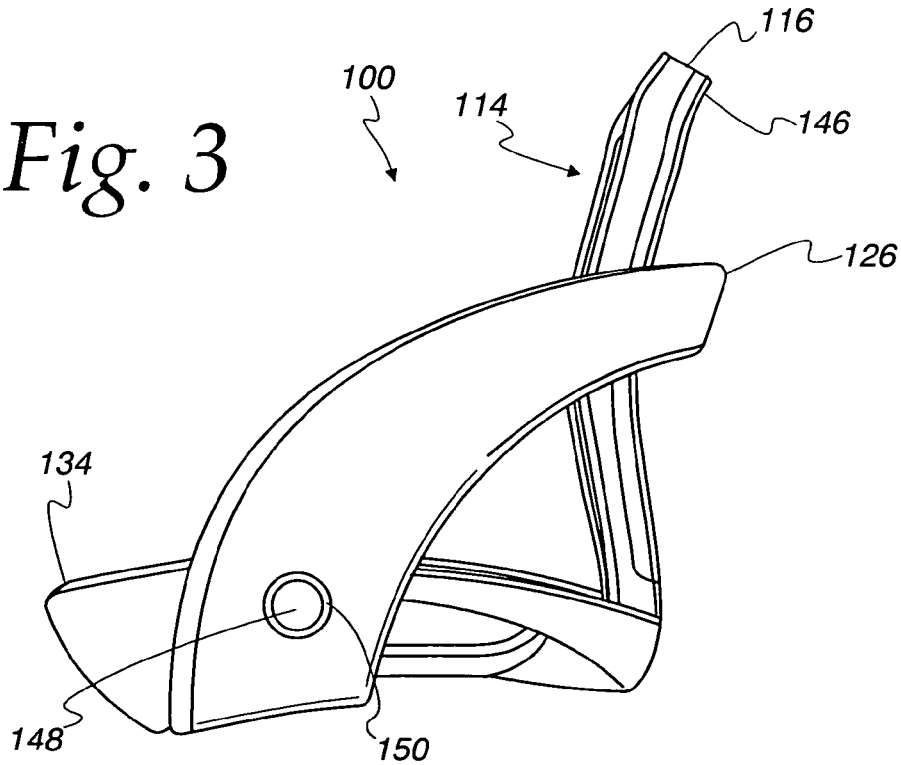
FIG. 3 is a side view of the example seat of FIG. 1.
Figure 4:
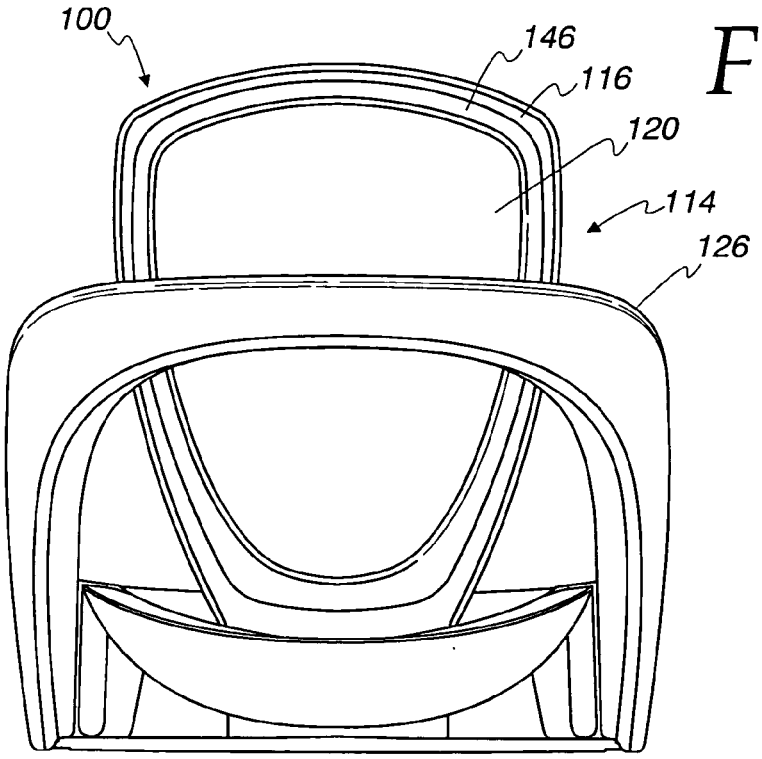
FIG. 4 is a rear view of the example seat of FIG. 1.

FIGS. 2, 3, and 4 are front, side, and rear views, respectively, of the example seat 100 shown in FIG. 1. As can be seen in FIGS. 3 and 4, the example seat 100 includes a trim piece 146 that may be inserted, pressed-into, or otherwise coupled to the back portion 114 to provide a desired aesthetic quality. For example, the trim piece 146 may be colored to match or complement the interior of a vehicle in which the seat 100 is to be mounted. As can be seen in FIG. 3, an axel or post portion 148 of the structure 144 (FIG. 1) extends through an opening 150 in the armrest structure 126, thereby pivotally holding the bolster assembly 132 to the example seat 100.

FIG. 5 is a perspective view of the example seat 100 of FIG. 1 having the armrest structure 126 removed to more clearly show the bolster assembly 132. The bolster assembly 132 is shown in FIG. 5, in a substantially vertical rotated condition. In this condition, for example, a vehicle operator may rest or be seated on an upper surface 150 of the bolster assembly 132 to obtain a better view of the vehicle perimeter to facilitate certain vehicle maneuvers (e.g., docking a boat). Alternatively or additionally, the vehicle operator may be afforded additional space or clearance in the front of the seat 100 when standing. As can be seen in FIG. 5, the structure 144 includes the post or axel 148 and a stop member 152. Although not shown in FIG. 5, the tab 136 includes a structure identical, but complementary, to the structure 144. The stop member 152 is configured to engage with a complementary structure or structures within the armrest structure 126 to stop the rotation of the bolster assembly 132. In the stopped condition, the bolster assembly 132 can support the weight of a vehicle operator (without further rotation) in, for example, a seated position.

Figure 6:
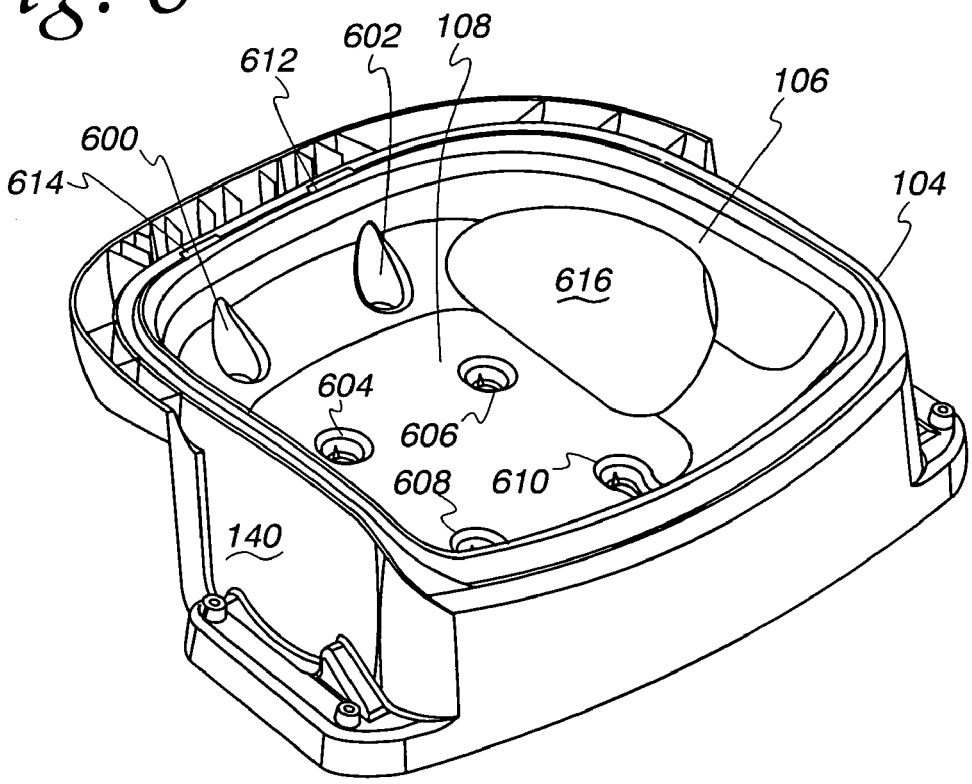
FIG. 6 is a detailed perspective view of the seat frame of FIG. 1.

Now turning to FIG. 6, a more detailed perspective view of the example frame 104 is shown. The carrier 112 and the membrane 110 have been removed from the view shown in FIG. 6 to more clearly illustrate the features of the cavity 108. The example frame 104 includes a plurality of openings or holes 600, 602, 604, and 606, some or all of which may be sized to accommodate a fastener to fix the frame 104 and, thus, the seat 100 to a seat mount such as, for example, a post or pedestal (not shown). One or more of the openings 600, 602, 604, and 606 may be left open (i.e., a fastener may not be used therein) to function as channel or drain through which any liquid water that is present in the cavity 108 may pass to be discharged from the seat 100. Further, the example frame 104 may include one or more lateral openings 616 (one of which can be seen in FIG. 6) to facilitate the movement of water away from the frame 104.

Figure 7:
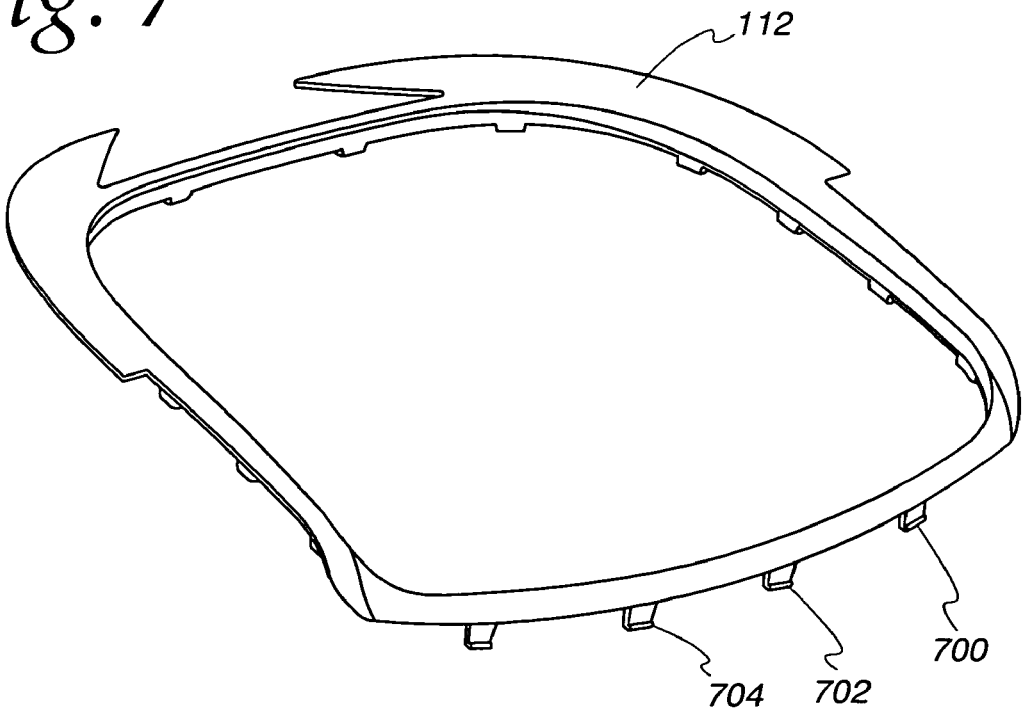
FIG. 7 is a detailed perspective view of the seat frame carrier shown in FIG. 1.

FIG. 7 is a more detailed perspective view of the example seat ring 112 of FIG. 1. As described above, the seat ring 112 is used to hold the membrane 110 in tension over the opening 106. The seat ring 112 includes a plurality of hooks or snaps 700, 702, and 704 that are configured to engage with the frame 104 to hold the seat ring 112 and the membrane 110 to the frame 104.

Figure 8:
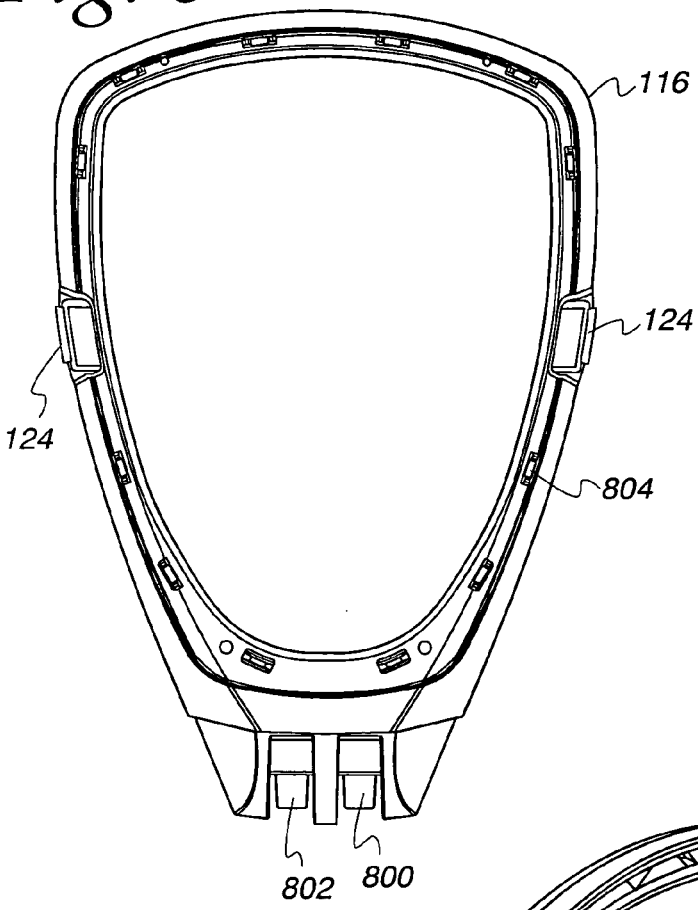
FIG. 8 is a detailed front view of the seat back frame of FIG. 1.
Figure 9:
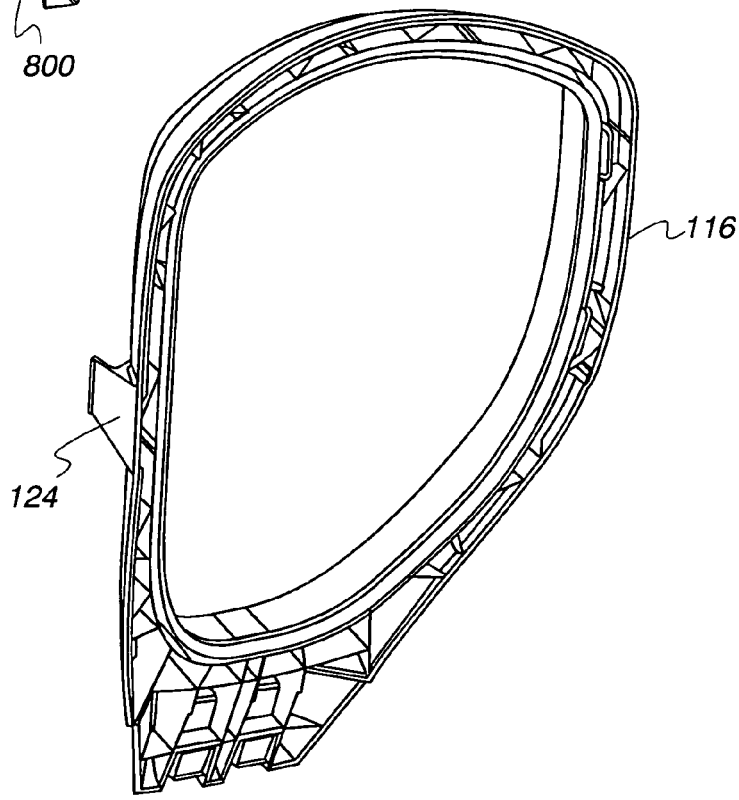
FIG. 9 is a detailed back perspective view of the seat back frame of FIG. 1.
Figure 10:
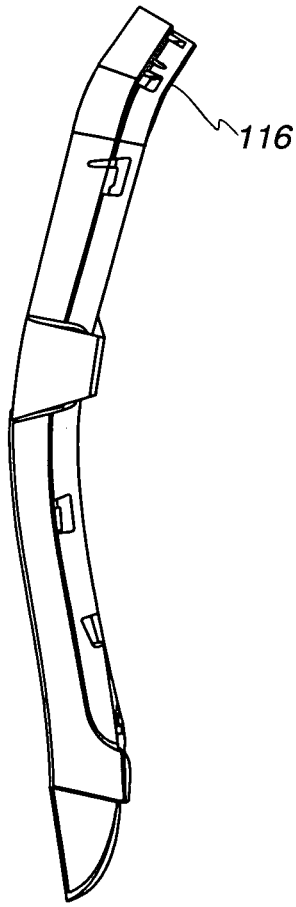
FIG. 10 is a detailed side view of the seat back frame of FIG. 1.
Figure 11:
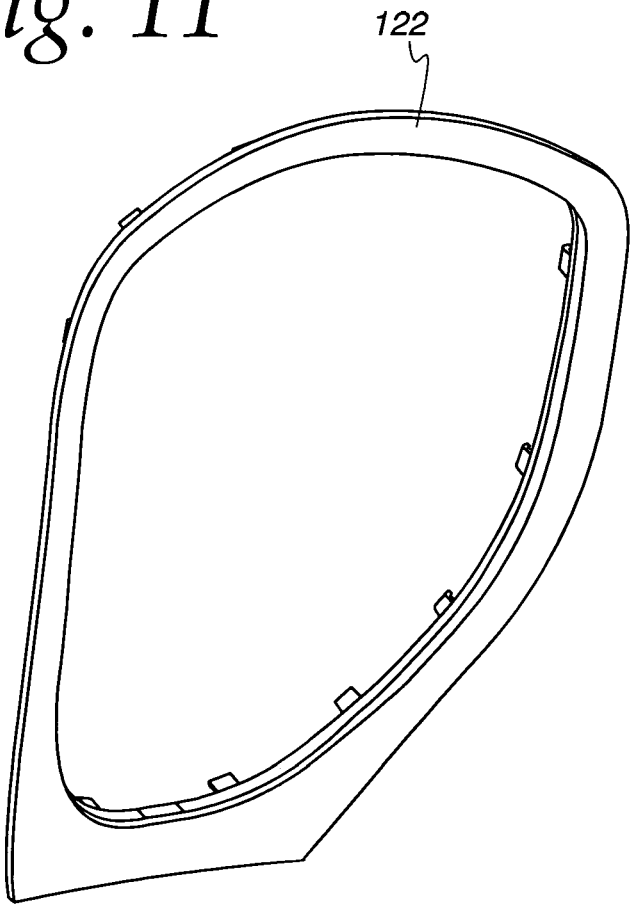
FIG. 11 is a detailed front perspective view of the seat back carrier of FIG. 1.

FIGS. 8 and 9 are more detailed front and back perspective views of the peripheral frame 116, and FIG. 10 is a side view of the peripheral frame 116. As shown in FIG. 8, locking members or tabs 800 and 802 are configured to slidably engage with slots 612 and 614 of the frame 104 (FIG. 6) to hold the hold the peripheral frame member 116 to the frame 104. The peripheral frame member 116 also includes a plurality of slots 804 for receiving the seat back carrier 122, which is shown in greater detail in FIG. 11.

Figure 12:
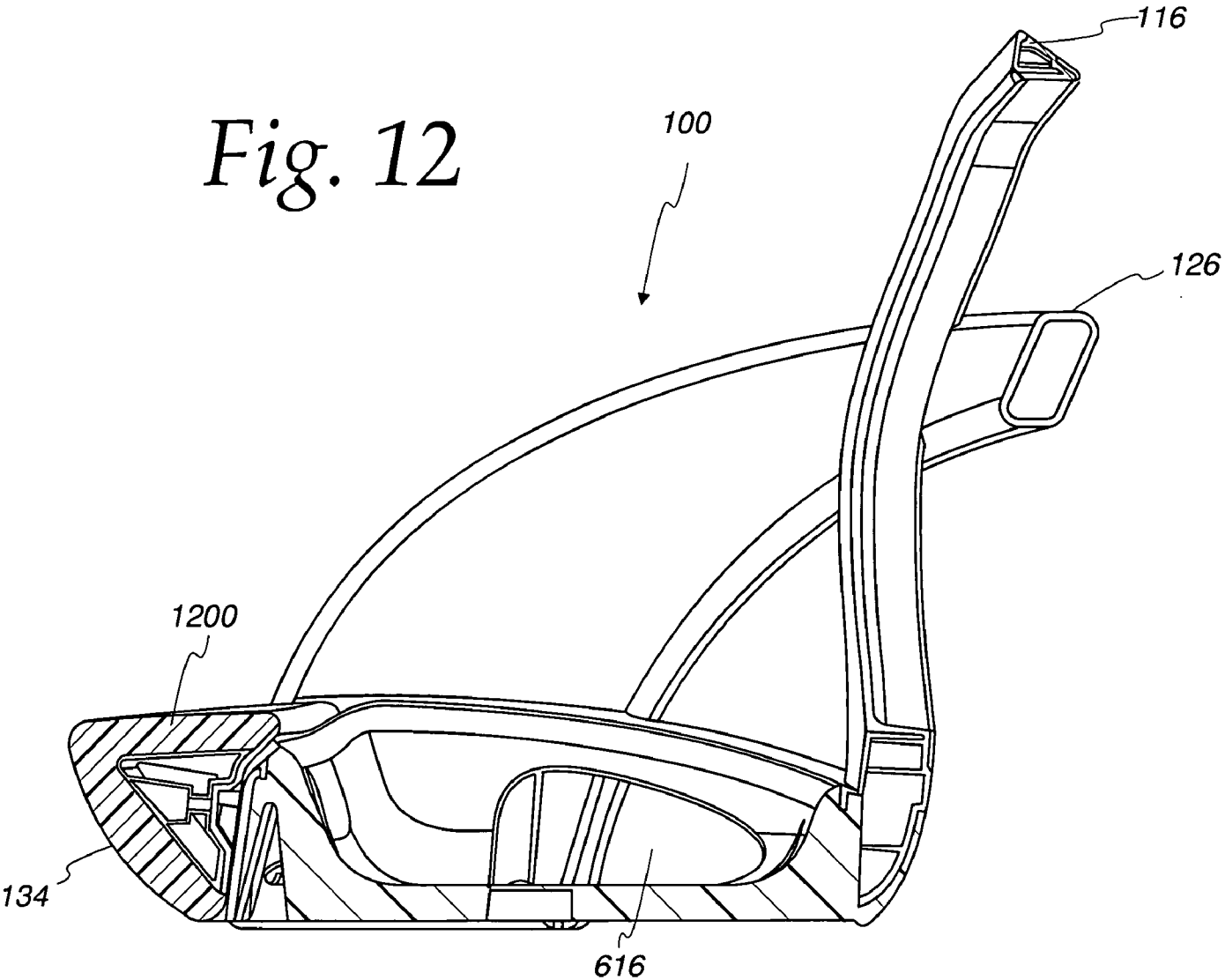
FIG. 12 is a detailed cross-sectional view of the example seat of FIG. 1.

FIG. 12 is a cross-sectional view of the example seat 100 of FIG. 1. As can be seen in FIG. 12, the armrest member 126, the bolster assembly 134, and the peripheral frame member 116 may be substantially hollow to minimize the amount of material and, thus, the weight and cost of these structural components. As depicted in FIG. 12, the bolster assembly 134 is upholstered with a foam padding 1200 that may be covered with an outer layer of a heavy vinyl or the like.

Although certain apparatus and articles of manufacture have been described herein, the scope of coverage of this patent is not limited thereto. To the contrary, this patent covers all embodiments fairly falling within the scope of the appended claims either literally or under the doctrine of equivalents.

What is claimed is:

1. A vehicle seat, comprising:

a seat portion configured to hold a seated person, wherein the seat portion comprises a substantially unitary molded frame defining a first opening and a cavity associated with the first opening and having a bottom wall opposite the first opening, wherein the seat portion further comprises a first substantially non-absorbent, water-permeable membrane configured to cover at least a portion of the first opening to provide support to the seated person, and wherein the substantially unitary molded frame comprises at least a second opening in the bottom wall and configured to enable water passing through the first substantially non-absorbent, water-permeable membrane and the first opening and into the cavity to be discharged from the cavity; and a back portion coupled to the seat portion, wherein the back portion comprises a peripheral frame member defining a third opening, and wherein at least a portion of the third opening is covered with a second substantially non-absorbent, water-permeable membrane.

2. A vehicle seat as defined in claim 1, wherein at least one of the first or second substantially non-absorbent, water-permeable membranes comprises a mesh material.

3. A vehicle seat as defined in claim 1, wherein the seat portion and the back portion comprise molded plastic structures.

4. A vehicle seat as defined in claim 1, further comprising a substantially unitary u-shaped structure configured to be coupled to the seat portion and the back portion to form armrests and provide support to the back portion.

5. A vehicle seat as defined in claim 4, wherein the substantially u-shaped structure comprises a molded plastic structure.

6. A vehicle seat as defined in claim 4, wherein the substantially unitary u-shaped structure and the back portion comprise complementary interlocking structures configured to couple the substantially unitary u-shaped structure to the back portion.

7. A vehicle seat as defined in claim 4, further comprising a bolster rotatable relative to the seat portion.

8. A vehicle seat as defined in claim 7, wherein the bolster and the substantially unitary u-shaped structure comprise complementary coupling structures to enable the bolster to rotate relative to the seat portion.

9. A vehicle seat as defined in claim 7, wherein the bolster is upholstered with a substantially non-absorbent, water-permeable membrane.

10. A vehicle seat as defined in claim 9, wherein the substantially non-absorbent, water-permeable membrane is made of a mesh material.

11. A vehicle seat as defined in claim 1, wherein the first opening is larger than the second opening.

12. A vehicle seat as defined in claim 1 further comprising a fourth opening configured to enable water passing through the membrane and into the cavity to be discharged from the cavity.

13. A vehicle seat as defined in claim 1, wherein the second opening is unobstructed.

14. A vehicle seat as defined in claim 7, wherein the bolster is a weight support structure to support the weight of a vehicle seat occupant.

15. A vehicle seat as defined in claim 7, further comprising a lock to maintain the bolster in a position.

* * * * *